US007865097B2

(12) United States Patent
Ishikawa

(10) Patent No.: US 7,865,097 B2
(45) Date of Patent: Jan. 4, 2011

(54) IMAGE FORMING APPARATUS AND CONTROL METHOD

(75) Inventor: Junji Ishikawa, Moriya (JP)

(73) Assignee: Canon Kabushiki Kaisha (JP)

( * ) Notice: Subject to any disclaimer, the term of this patent is extended or adjusted under 35 U.S.C. 154(b) by 180 days.

(21) Appl. No.: 12/185,936

(22) Filed: Aug. 5, 2008

(65) Prior Publication Data

US 2009/0041495 A1 Feb. 12, 2009

(30) Foreign Application Priority Data

Aug. 7, 2007 (JP) ..... 2007-205847

(51) Int. Cl.
*G03G 15/02* (2006.01)

(52) U.S. Cl. ..... 399/50; 399/66; 399/101; 399/308; 399/314

(58) Field of Classification Search ..... 399/66, 399/101, 308, 314, 50
See application file for complete search history.

(56) References Cited

U.S. PATENT DOCUMENTS 5,179,397 A * 1/1993 Ohzeki et al. ..... 347/140
6,026,257 A 2/2000 Takami et al.
6,532,347 B2 3/2003 Watanabe et al.
2006/0153604 A1 * 7/2006 Matsuda et al. ..... 399/301

FOREIGN PATENT DOCUMENTS

JP 11-95581 A 4/1999
JP 2001-201920 A 7/2001

* cited by examiner

*Primary Examiner*—David M Gray
*Assistant Examiner*—Barnabas T Fekete
(74) *Attorney, Agent, or Firm*—Rossi, Kimms & McDowell LLP

(57) ABSTRACT

The present invention provides an image forming apparatus comprising an image forming unit configured to form an image on an image carrier, a transfer unit configured to transfer the image formed on the image carrier onto a transfer medium, a voltage applying unit configured to apply a voltage to the transfer unit, a current detection unit configured to detect a current that flows through the transfer unit when the voltage applying unit applies the voltage, and a control unit configured to control the voltage applying unit based on a detection result of the current detection unit.

4 Claims, 11 Drawing Sheets

IMAGE FORMING APPARATUS AND CONTROL METHOD

BACKGROUND OF THE INVENTION

1. Field of the Invention

The present invention relates to an image forming apparatus using an electrophotographic method, and a control method. The present invention is suitable for an image forming apparatus such as a copying machine, printer, facsimile apparatus, and the like.

2. Description of the Related Art

Along with prevalence of image forming apparatuses such as laser printers and the like, such image forming apparatuses are increasingly required to attain higher image quality and to reduce cost. An image forming apparatus includes a primary charger for uniformly charging a photosensitive member, a primary transfer unit for transferring a toner image formed on the photosensitive member onto an intermediate transfer belt, and a secondary transfer unit for transferring the toner image on the intermediate transfer belt on a print sheet.

As components of the primary and secondary transfer units, in recent years, a transfer member of a contact transfer type (contact transfer member) represented by a transfer roller becomes mainstream. The contact transfer member can realize a size reduction of a power supply capacity and a reduction of the generation amount of discharge products (ozone and the like) compared to a corona charger of a non-contact type and the like. The transfer roller includes, for example, a shaft, and an elastic layer of a middle resistance, which is formed around the shaft, and is brought into pressure contact with the intermediate transfer belt or print sheet at a predetermined pressure to form a transfer part (transfer nip). While a toner image is passing through the transfer part (i.e., during an interval from when the toner image reaches the transfer part until it leaves there), a transfer bias applying unit applies a predetermined transfer bias (transfer voltage) to the shaft of the transfer roller. Note that since the characteristic of the transfer roller changes due to an environmental change, temporal change, and the like, the transfer bias to be applied to the transfer roller (shaft) needs to be appropriately controlled in accordance with the characteristic of the transfer roller.

Hence, Japanese Patent Laid-Open No. 11-95581 has proposed an image forming apparatus which controls a transfer bias to be applied to the transfer roller in accordance with the characteristic of the transfer roller. Such image forming apparatus controls to set a current which flows through the transfer roller to assume a predetermined value at a timing at which a non-image-forming area is located on the transfer part (constant current control), and also controls the transfer bias on an image-forming area based on a voltage applied at this time (constant voltage control). Note that this non-image-forming area includes areas, on which no image is formed, on the front side of the leading edge of an image for one page and on the rear side of the trailing edge of that image on the photosensitive member or intermediate transfer belt. Also, another image forming apparatus has been proposed. In this apparatus, impedances of the transfer roller are computed by applying a plurality of different voltages while one non-image-forming area is located on the transfer part, a voltage, at which a current that flows through the transfer roller assumes a predetermined value, is computed, and that voltage is used as the transfer bias for an image-forming area.

On the other hand, as the primary charger, a charging member of a contact charging type represented by a charging roller becomes mainstream. The charging roller is brought into contact with the surface of the photosensitive member to apply a charging bias (e.g., a charging voltage generated by superposing an AC voltage on a DC voltage), thereby charging the surface of the photosensitive member. In this case, by setting the AC voltage to be equal to or higher than a discharge start voltage, an effect of uniforming charges on the photosensitive member is provided, thus uniformly charging the photosensitive member.

However, when a DC voltage and AC voltages are superposed and applied to the photosensitive member, since the discharging amount to the photosensitive member increases compared to a case in which only a DC voltage is applied to the photosensitive member, degradation (scraping, etc.) of the photosensitive member is promoted, and an image blur or the like due to discharge products occurs in a high-temperature, high-humidity environment. Therefore, an AC voltage to be superposed on a DC voltage needs to be minimized to suppress discharging. However, the relationship between the voltage to be applied to the charging roller and the discharging amount is not always constant, and the discharging amount changes due to an environmental change, temporal change of the photosensitive member, and the like.

To solve this problem, Japanese Patent Laid-Open No. 2001-201920 has proposed an image forming apparatus which suppresses an increase/decrease in discharging amount due to an environmental change, temporal change, and the like by controlling a charging bias to be applied to the charging roller. This image forming apparatus computes the impedances of the charging roller and discharging amounts by applying a plurality of different AC voltages for a non-discharging area and discharging area prior to image formation. During image formation, the apparatus applies an AC voltage of one value of the non-discharging area on a non-image-forming area, and determines a charging bias based on a current that flows through the charging roller at that time, and the impedances of the charging roller and discharging amounts computed before image formation.

However, an image forming apparatus disclosed in Japanese Patent Laid-Open No. 11-95581 executes constant current control of a circuit that generates a transfer bias while a non-image-forming area is located on a transfer part, and executes constant voltage control while an image-forming area is located on the transfer part. For this reason, this apparatus must include both a constant current control circuit and constant voltage control circuit. Therefore, the cost of the image forming apparatus increases.

As described above, upon computing the impedance of the transfer roller, since one non-image-forming area is located on the transfer part for a very short period of time, a transfer bias applying circuit that can change voltage values to be applied to the transfer roller at high speed is required. Therefore, the image forming apparatus needs to equip a high-voltage power supply with quick response, resulting in an increase in cost of the image forming apparatus.

On the other hand, since the image forming apparatus disclosed in Japanese Patent Laid-Open No. 2001-201920 determines a voltage to be applied on the image-forming area based on the impedance of the charging roller and discharging amount, which are predicted by applying the AC voltage of only one value on the non-image-forming area, it is very difficult to control the charging bias with high precision.

SUMMARY OF THE INVENTION

The present invention provides an image forming apparatus which can control biases (voltages) to be applied to a transfer roller and charging roller with high precision without increasing the cost.

According to the first aspect of the present invention, there is provided an image forming apparatus comprises an image forming unit configured to form an image on an image carrier, a transfer unit configured to transfer the image formed on the image carrier onto a transfer medium, a voltage applying unit configured to apply a voltage to the transfer unit, a current detection unit configured to detect a current that flows through the transfer unit when the voltage applying unit applies the voltage, and a control unit configured to control the voltage applying unit based on a detection result of the current detection unit, wherein when a plurality of images are to be formed continuously, the control unit controls the voltage applying unit to apply a voltage of a first value to the transfer unit during a first period in which a first non-image-forming area where no image is formed is located on the transfer unit, and controls the voltage applying unit to apply a voltage of a second value to the transfer unit during a second period in which a second non-image-forming area is located on the transfer unit, and an image-forming area is existed between the first non-image-forming area and the second non-image-forming area, and wherein the control unit determines a voltage value of a voltage to be applied from the voltage applying unit to the transfer unit on the image-forming area where an image is formed is located on the transfer unit, based on the voltage of the first value, the voltage of the second value, and the detection results of the current detection unit during the first period and the second period.

According to the second aspect of the present invention, there is provided an image forming apparatus comprises a photosensitive member, a charger configured to charge the photosensitive member, a voltage applying unit configured to apply a voltage to the charger, a current detection unit configured to detect a current that flows through the charger upon application of the voltage by the voltage applying unit, and a control unit configured to control the voltage applying unit based on a detection result of the current detection unit, wherein when a plurality of images are to be formed continuously, the control unit controls the voltage applying unit to apply a voltage of a first value that does not cause discharging by the charger during a first period in which a first non-image-forming area is located on a charging part where the photosensitive member is charged by the charger, to apply a voltage of a second value that does not cause discharging during a second period in which a second non-image-forming area is located on the charging part, to apply a voltage of a third value that causes discharging during a third period in which a third non-image-forming area is located on the charging part, and to apply a voltage of a fourth value that causes discharging during a fourth period in which a fourth non-image-forming area is located on the charging part, and image-forming areas are existed between the neighboring first to fourth non-image-forming areas, and wherein the control unit determines a voltage value to be applied from the voltage applying unit to the charger during a period in which the image-forming area where an image is formed is located on the charging part, based on the voltages of the first to fourth values, and the detection results of the current detection unit during the first to fourth periods.

According to the third aspect of the present invention, there is provided a method of controlling an image forming apparatus, which comprises an image forming unit which forms an image on an image carrier, a transfer unit which transfers the image formed on the image carrier onto a transfer medium, a voltage applying unit which applies a voltage to the transfer unit, and a current detection unit which detects a current that flows through the transfer unit when the voltage applying unit applies the voltage, the method comprises a first voltage applying step of controlling the voltage applying unit to apply a voltage of a first value to the transfer unit during a first period in which a first non-image-forming area where no image is formed is located on the transfer unit, a second voltage applying step of controlling the voltage applying unit to apply a voltage of a second value to the transfer unit during a second period in which a second non-image-forming area is located on the transfer unit, and a determination step of determining a voltage value of a voltage to be applied from the voltage applying unit to the transfer unit on an image-forming area where an image is formed is located on the transfer unit, based on the voltage of the first value, the voltage of the second value, and the detection results of the current detection unit during the first period and the second period, wherein the image-forming area is existed between the first non-image-forming area and the second non-image-forming area.

According to the fourth aspect of the present invention, there is provided a method of controlling an image forming apparatus, which comprises a photosensitive member, a charger which charges the photosensitive member, a voltage applying unit which applies a voltage to the charger, and a current detection unit which detect a current that flows through the charger upon application of the voltage by the voltage applying unit, the method comprises a first voltage applying step of controlling the voltage applying unit to apply a voltage of a first value that does not cause discharging by the charger during a first period in which a first non-image-forming area is located on a charging part where the photosensitive member is charged by the charger, a second voltage applying step of controlling the voltage applying unit to apply a voltage of a second value that does not cause discharging during a second period in which a second non-image-forming area is located on the charging part, a third voltage applying step of controlling the voltage applying unit to apply a voltage of a third value that causes discharging during a third period in which a third non-image-forming area is located on the charging part, a fourth voltage applying step of controlling the voltage applying unit to apply a voltage of a fourth value that causes discharging during a fourth period in which a fourth non-image-forming area is located on the charging part; and a determination step of determining a voltage value to be applied from the voltage applying unit to the charger during a period in which an image-forming area where an image is formed is located on the charging part, based on the voltages of the first to fourth values, and the detection results of the current detection unit during the first to fourth periods, wherein a first image-forming area exists between the first non-image-forming area and the second non-image-forming area, a second image-forming area exists between the second non-image-forming area and the third non-image-forming area, and a third image-forming area exists between the third non-image-forming area and the fourth non-image-forming area.

Further features of the present invention will become apparent from the following description of exemplary embodiments with reference to the attached drawings.

DESCRIPTION OF THE EMBODIMENTS

Figure 1:
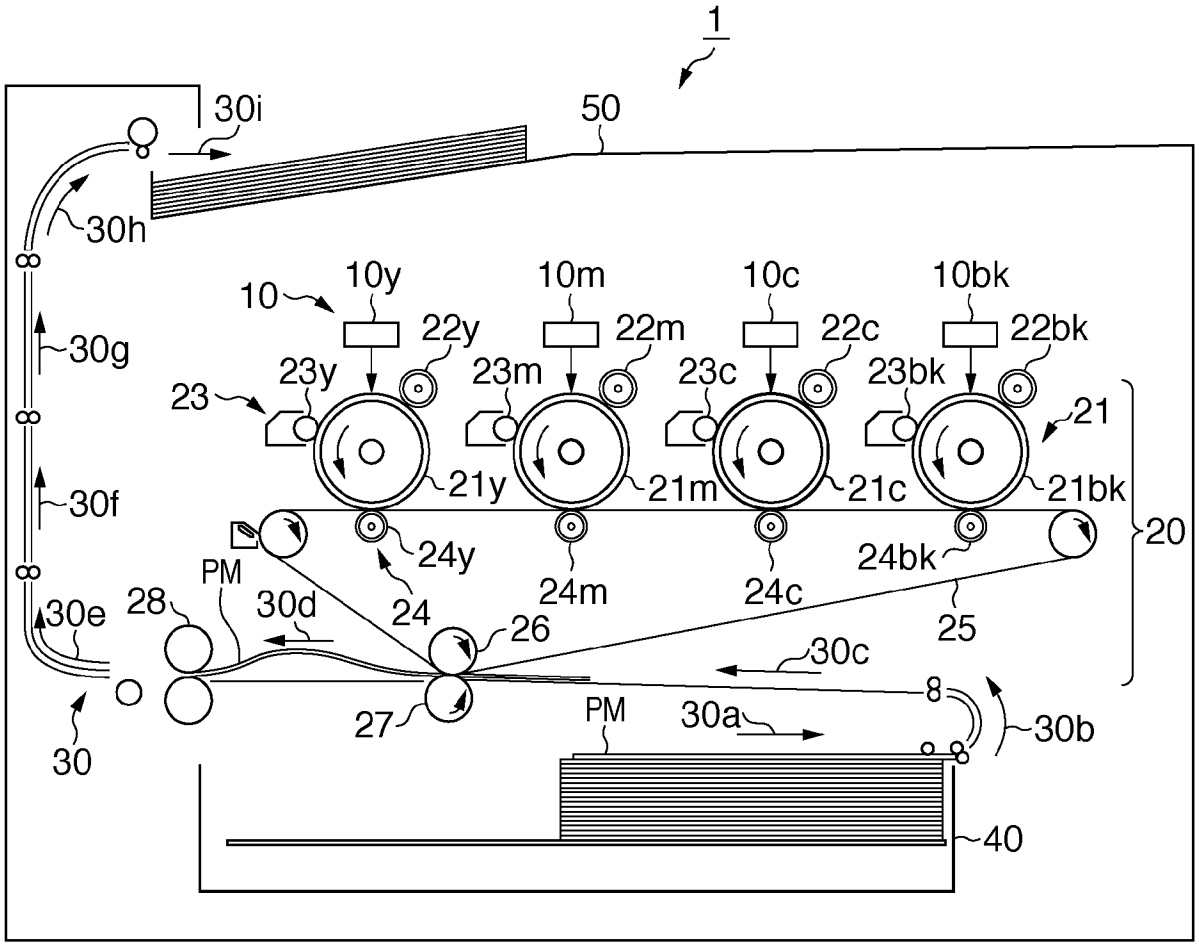
FIG. 1 is a schematic sectional view showing the arrangement of an image forming apparatus.

Preferred embodiments of the present invention will be described hereinafter with reference to the accompanying drawings. Note that the same reference numerals denote the same components throughout the drawings, and a repetitive description thereof will be avoided.

FIG. 1 is a schematic sectional view showing the arrangement of an image forming apparatus 1 as one aspect of the present invention. The image forming apparatus 1 forms an image (color image) on a print medium PM using an electrophotographic method. The image forming apparatus 1 is embodied as a color laser printer, which superposes and transfers toner images of respective colors, that is, yellow, magenta, cyan, and black onto the print medium PM, and heats and presses the print medium PM to fix the toner images on the print medium PM.

As shown in FIG. 1, the image forming apparatus 1 includes a laser unit 10, image forming unit 20, conveying unit 30, paper cassette 40, and exhaust tray 50. The image forming apparatus 1 further includes a primary transfer bias applying mechanism 60 shown in FIG. 2, a secondary transfer bias applying mechanism 70 shown in FIG. 5, and a primary charging bias applying mechanism 80 shown in FIG. 8.

The laser unit 10 generates a laser beam which is modulated based on an image signal input from an image signal generation apparatus such as an image reading apparatus, computer, or the like, and exposes a photosensitive drum 21 of the image forming unit 20 with that laser beam. The laser unit 10 controls the exposure amount on the photosensitive drum 21 by ON/OFF control and PWM control, thereby forming an electrostatic latent image on the surface of the photosensitive drum 21. In this embodiment, the laser unit 10 includes four laser units 10*y*, 10*m*, 10*c*, and 10*bk* in correspondence with the colors, that is, yellow, magenta, cyan, and black.

The image forming unit 20 forms a visible image by developing each electrostatic latent image formed by the laser unit 10 with toner, and superposes and transfers such visible images, thus forming a color visible image. Furthermore, the image forming unit 20 transfers the color visible image on a print medium (sheet) PM on a transfer part, and fixes the color visible image transferred onto the print medium PM, thereby forming an image on the print medium PM.

The image forming unit 20 includes the photosensitive drum 21, a primary charging roller 22, developing sleeve 23, primary transfer roller 24, intermediate transfer belt 25, secondary transfer inner roller 26, secondary transfer outer roller 27, and fixing unit 28. Note that, in this embodiment, the photosensitive drum 21 includes four photosensitive drums 21*y*, 21*m*, 21*c*, and 21*bk* in correspondence with the colors, that is, yellow, magenta, cyan, and black. Likewise, in this embodiment, the primary charging roller 22 includes four primary charging rollers 22*y*, 22*m*, 22*c*, and 22*bk* in correspondence with the colors, that is, yellow, magenta, cyan, and black. Likewise, in this embodiment, the developing sleeve 23 includes four developing sleeves 23*y*, 23*m*, 23*c*, and 23*bk* in correspondence with the colors, that is, yellow, magenta, cyan, and black. Likewise, in this embodiment, the primary transfer roller 24 includes four primary transfer rollers 24*y*, 24*m*, 24*c*, and 24*bk* in correspondence with the colors, that is, yellow, magenta, cyan, and black. Since the photosensitive drum 21, primary charging roller 22, developing sleeve 23, and primary transfer roller 24 have the same arrangements for respective colors, the photosensitive drum 21*y*, primary charging roller 22*y*, developing sleeve 23*y*, and primary transfer roller 24*y* corresponding to yellow will be exemplified below.

The photosensitive drum 21*y* carries a yellow electrostatic latent image, and rotates counterclockwise in this embodiment.

The primary charging roller 22*y* applies a high voltage to the photosensitive drum 21*y* to uniformly charge (to a minus potential) the surface of the photosensitive drum 21*y* that has passed the primary charging roller 22*y*. The primary charging roller 22*y* is applied with a voltage obtained by superposing a voltage of AC components ranging from 1,300 V to 2,000 V (AC voltage) onto a voltage of DC components ranging from −300 V to −700 V (DC voltage) via the primary charging bias applying mechanism 80 (to be described later). As a result, the primary charging roller 22*y* can uniformly charge the surface of the photosensitive drum 21*y*.

The surface of the photosensitive drum 21*y* that has passed the primary charging roller 22*y* and was uniformly charged is exposed with a laser beam radiated from the laser unit 10*y*, as described above. The surface of the photosensitive drum 21*y* exposed with the laser beam is photosensitized and its impedance (charging amount) lowers.

The developing sleeve 23*y* is arranged to have a gap with respect to the photosensitive drum 21*y*. The gap between the photosensitive drum 21*y* and developing sleeve 23*y* is managed with high precision. The developing sleeve 23*y* is applied with a voltage obtained by superposing a voltage of AC components ranging from −1,000 V to −2,000 V onto a voltage of DC components ranging from −150 V to −500 V.

As a result, an electric field is generated between the photosensitive drum 21*y* and developing sleeve 23*y*.

Upon application of the voltage to the developing sleeve 23*y*, voltages of DC and AC components are generated as in the charging process of the photosensitive drum 21*y*. In particular, the voltage of the AC components largely influences the image quality in a developing process.

The direction and strength of the electric field generated between the photosensitive drum 21*y* and developing sleeve 23*y* is influenced by the charging amount of the surface of the photosensitive drum 21*y*. For example, on a surface portion of the photosensitive drum 21*y* having a large negative charging amount (i.e., that portion is not exposed with the laser beam), an electric field in a direction from the developing sleeve 23*y* toward the photosensitive drum 21*y* is generated. On the other hand, on a surface portion of the photosensitive drum 21*y* having a small charging amount (i.e., that portion is exposed with the laser beam), an electric field in a direction from the photosensitive drum 21*y* to the developing sleeve 23*y* is generated.

A minus-charged yellow toner on the developing sleeve 23*y* receives a force in a direction opposite to the direction of the electric field generated between the photosensitive drum 21*y* and developing sleeve 23*y*. Therefore, depending on the directions and magnitudes of the strengths of the electric field generated between the photosensitive drum 21*y* and developing sleeve 23*y*, the yellow toner becomes attached to an electrostatic latent image formed on the photosensitive drum 21*y*, thus forming a toner image (visible image). In other words, the developing sleeve 23*y* develops an electrostatic latent image formed on the photosensitive drum 21*y*. Note that the developing sleeve 23*y* may be replaced by a developing blade.

The primary transfer roller 24*y* is arranged on the side opposite to the photosensitive drum 21*y* to sandwich the intermediate transfer belt 25 between them. The intermediate transfer belt 25 is arranged in contact with the surface of the photosensitive drum 21*y*.

The primary transfer roller 24*y* is applied with a voltage ranging from +150 V to +1,500 V via the primary transfer bias applying mechanism 60 (to be described later). As a result, the minus-charged yellow toner is attracted from the photosensitive drum 21*y* to the primary transfer roller 24*y* side, and a yellow toner image formed on the photosensitive drum 21*y* is transferred onto the intermediate transfer belt 25.

Likewise, magenta, cyan, and black toner images are transferred onto the intermediate transfer belt 25. As a result, a full-color toner image formed by yellow, magenta, cyan, and black toners is formed on the intermediate transfer belt 25.

The secondary transfer inner roller 26 and secondary transfer outer roller 27 are arranged to oppose each other to sandwich the intermediate transfer belt 25 between them. Therefore, the intermediate transfer belt 25 on which the toner image is formed passes a portion between the secondary transfer inner roller 26 and secondary transfer outer roller 27. At this time, the conveying unit 30 conveys a print medium PM to the portion between the intermediate transfer belt 25 and secondary transfer outer roller 27. Note that the conveying unit 30 is configured by, for example, a conveyor belt, conveying rollers, and the like, and conveys a print medium PM stored in the paper cassette 40 in directions of arrows 30*a*, 30*b*, 30*c*, 30*d*, 30*e*, 30*f*, 30*g*, 30*h*, and 30*i*.

The secondary transfer outer roller 27 is applied with a voltage ranging from +500 V to +7,000 V via the secondary transfer bias applying mechanism 70 (to be described later). As a result, a minus-charged toner image on the intermediate transfer belt 25 is transferred onto a print medium PM.

The fixing unit 28 fixes a non-fixed toner image (in a state in which it is easily peeled from the print medium PM) transferred on the print medium PM onto the print medium PM. The fixing unit 28 includes, for example, a heat roller which fixes the toner image onto the print medium PM by applying a heat and pressure to the print medium PM.

The print medium PM on which the toner image is fixed is conveyed by the conveying unit 30, and is exhausted onto the exhaust tray 50. The exhaust tray 50 stacks print media PM on which images are formed.

Control of biases to be applied to members associated with formation and transfer of an image (i.e., the primary transfer roller 24, secondary transfer outer roller 27, and primary charging roller 22) in the image forming apparatus 1 will be described below.

Figure 2:
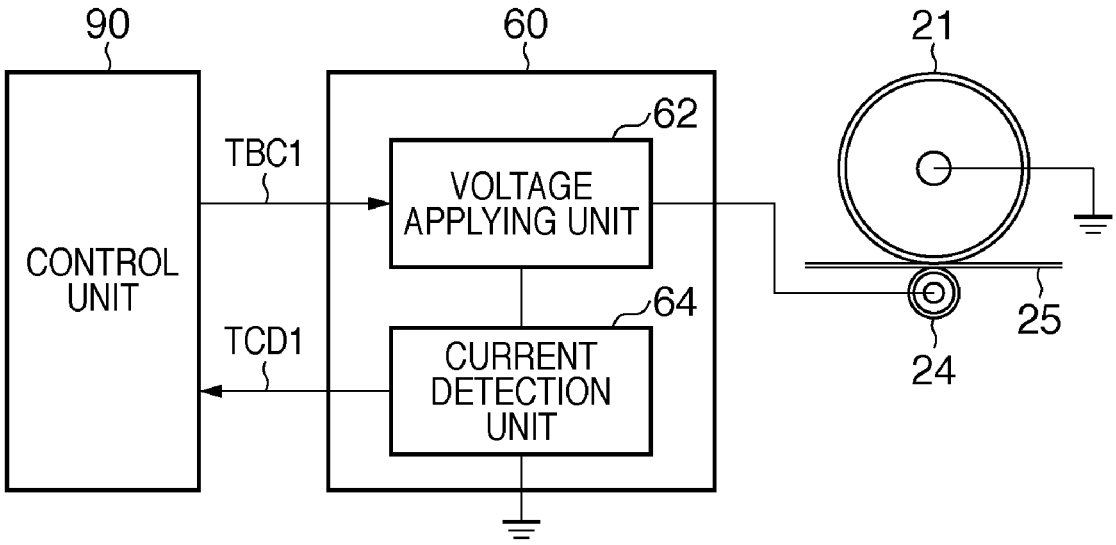
FIG. 2 is a schematic block diagram showing the arrangement of a primary transfer bias applying mechanism.

FIG. 2 is a schematic block diagram showing the arrangement of the primary transfer bias applying mechanism 60 which applies a transfer bias to the primary transfer roller 24. The primary transfer bias applying mechanism 60 includes a voltage applying unit 62 and current detection unit 64, as shown in FIG. 2.

The voltage applying unit 62 is controlled by a control unit 90, and has a function of applying a voltage to the primary transfer roller 24 as a member associated with transfer of an image. The voltage applying unit 62 generates a voltage (primary transfer voltage) to be applied to the primary transfer roller 24 based on a primary transfer bias control signal TBC1 input from the control unit 90, and applies that voltage to the primary transfer roller 24. For example, the voltage applying unit 62 generates a high voltage using a high-voltage transformer from, for example, an output of a 24-V power supply.

The current detection unit 64 detects a current that flows through the primary transfer roller 24 when the voltage applying unit 62 applies the voltage. In this embodiment, the current detection unit 64 detects a current (primary transfer current) which flows via the primary transfer roller 24, intermediate transfer belt 25, photosensitive drum 21, and the like, and outputs a primary transfer current detection signal TCD1 indicating the current value of that current to the control unit 90.

The control unit 90 includes a CPU and memory (neither are shown), and controls the operation of the image forming apparatus 1. The control unit 90 controls the voltage applying unit 62 based on the detection result (i.e., the current value of the current that flows through the primary transfer roller 24) of the current detection unit 64 in the primary transfer bias applying mechanism 60. In other words, the control unit 90 generates the primary transfer bias control signal TBC1 indicating a voltage value to be applied from the voltage applying unit 62 to the primary transfer roller 24, based on the primary transfer current detection signal TCD1 input from the current detection unit 64, and outputs the generated signal to the voltage applying unit 62.

The transfer bias control of the primary transfer bias applying mechanism 60 in the continuous operations (upon forming a plurality of images) of the image forming apparatus 1 will be described below with reference to FIGS. 3 and 4.

Figure 3:
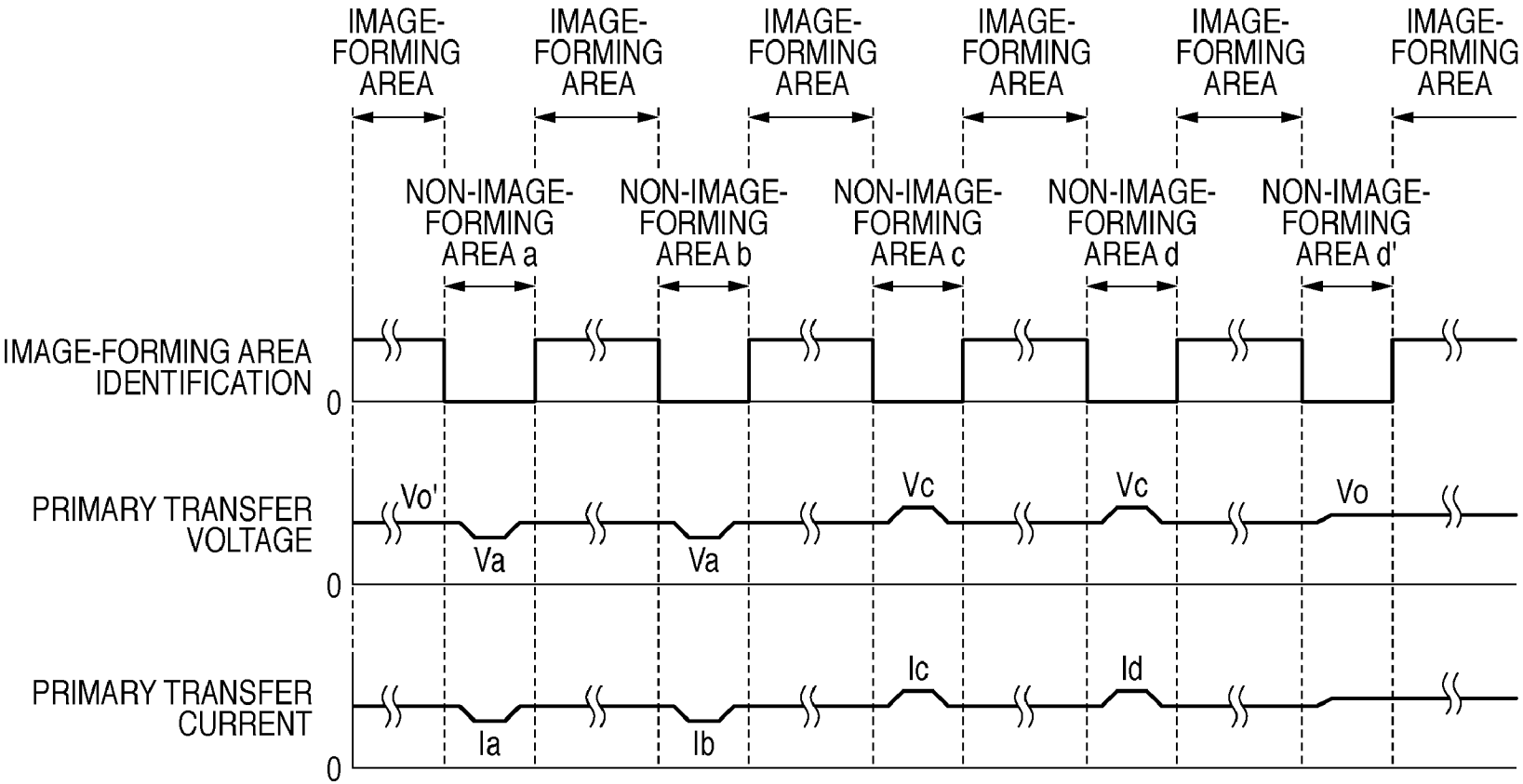
FIG. 3 is a chart showing a primary transfer voltage and primary transfer current.

FIG. 3 is a chart showing the primary transfer voltage and primary transfer current during periods in each of which an image-forming area is located on a transfer part and periods in each of which a non-image-forming area is located on the transfer part in the continuous operations of the image forming apparatus 1. In FIG. 3, the transfer part is a part where the primary transfer roller 24 and intermediate transfer belt 25 contact each other. The image-forming area is an area where a toner image can be formed from the leading end to the trailing end of an image for one page on the photosensitive drum 21. The non-image-forming area includes areas where no toner image exists before the leading end and after the trailing end of an image for one page on the photosensitive drum 21.

Referring to FIG. 3, during periods in each of which the image-forming area is located on the transfer part, the control unit 90 controls the voltage applying unit 62 to apply a voltage with a voltage value Vo' (normal primary transfer voltage) to the primary transfer roller 24. Note that the voltage Vo' is a primary transfer bias, which is determined last.

During periods in which non-image-forming areas a and b are respectively located on the transfer part, the control unit 90 controls the voltage applying unit 62 to apply a voltage with a voltage value Va to the primary transfer roller 24. In this case, during the periods in which non-image-forming areas a and b are respectively located on the transfer part, the control unit 90 acquires, via the current detection unit 64, values Ia and Ib of currents that flows through the primary transfer roller 24 upon application of the voltage of the voltage value Va by the voltage applying unit 62. Also, the control unit 90 computes an average current value Iab as an average of the current values Ia and Ib.

Furthermore, during periods in which non-image-forming areas c and d are respectively located on the transfer part, the control unit 90 controls the voltage applying unit 62 to apply a voltage with a voltage value Vc to the primary transfer roller 24. In this case, during the periods in which non-image-forming areas c and d are respectively located on the transfer part, the control unit 90 acquires, via the current detection unit 64, values Ic and Id of currents that flow through the primary transfer roller 24 upon application of the voltage of the voltage value Vc by the voltage applying unit 62. Also, the control unit 90 computes an average current value Icd as an average of the current values Ic and Id.

Figure 4:
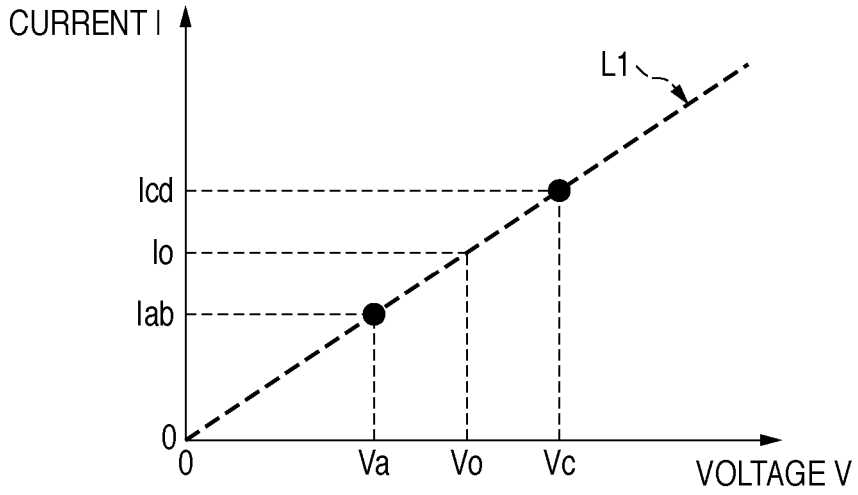
FIG. 4 is a graph showing the relationship between a voltage (voltage value) to be applied to a primary transfer roller and a current (current value) that flows through the primary transfer roller.

FIG. 4 is a graph showing the relationship between a voltage (voltage value) V to be applied to the primary transfer roller 24 and a current (current value) I that flows through the primary transfer roller 24. In FIG. 4, the abscissa plots the voltage V to be applied to the primary transfer roller 24, and the ordinate plots the current I that flows through the primary transfer roller 24. Referring to FIG. 4, the control unit 90 computes an equation that expresses a line L1 from the average current values Iab and Icd of the currents that flow through the primary transfer roller 24 when the voltage applying unit 62 applies the voltages of the voltage values Va and Vc to the primary transfer roller 24, in accordance with equation (1) below. In other words, the control unit 90 computes an impedance characteristic (line L1) of the primary transfer roller 24 based on the voltage values Va and Vc and the average current values Iab and Icd.

$$V-Va=\{(Vc-Va)/(Icd-Iab)\}\cdot(I-Iab) \quad (1)$$

Next, the control unit 90 computes a voltage value Vo at which a current that flows through the primary transfer roller 24 assumes a predetermined current value Io, based on the line L1 indicating the impedance characteristic of the primary transfer roller 24, and determines the voltage value Vo as a primary transfer bias voltage to be applied from the voltage applying unit 62 to the primary transfer roller 24. The control unit 90 controls the voltage applying unit 62 to apply a voltage of the voltage value Vo to the primary transfer roller 24 during periods in each of which the image-forming area is located on the transfer part.

In this manner, the control unit 90 controls the voltage applying unit 62 to apply a voltage of a first voltage value (Va) to the primary transfer roller 24 during periods in which first non-image-forming areas (non-image-forming areas a and b) of a plurality of non-image-forming areas are respectively located on the transfer part. Also, the control unit 90 controls the voltage applying unit 62 to apply a voltage of a second voltage value (Vc) to the primary transfer roller 24 during periods in which second non-image-forming areas (non-image-forming areas c and d) of the plurality of non-image-forming areas are respectively located on the transfer part. In this case, the control unit 90 acquires first current values (Ia and Ib) of currents that flow through the primary transfer roller 24 upon applying the voltage of the first voltage value, and second current values (Ic and Id) of currents that flow through the primary transfer roller 24 upon applying the voltage of the second voltage value. Then, the control unit 90 computes the impedance characteristic of the primary transfer roller 24 based on an average current value (Iab) of the first current values, and an average current value (Icd) of the second current values. After that, the control unit 90 determines a voltage value (Vo) of a voltage to be applied to the primary transfer roller 24 based on the impedance characteristic, so that the current value of a current, that flows through the primary transfer roller 24 in a period in which the next image-forming area is located on the transfer part, assumes a predetermined value (Io). Note that during a preparation operation (pre-rotation) required to start an image forming operation, the control unit 90 detects the values Ia and Ib of currents that flow through the primary transfer roller 24 while changing a voltage to be applied to the primary transfer roller 24 to Va and Vb, thereby determining the voltage Vo'.

Figure 11:
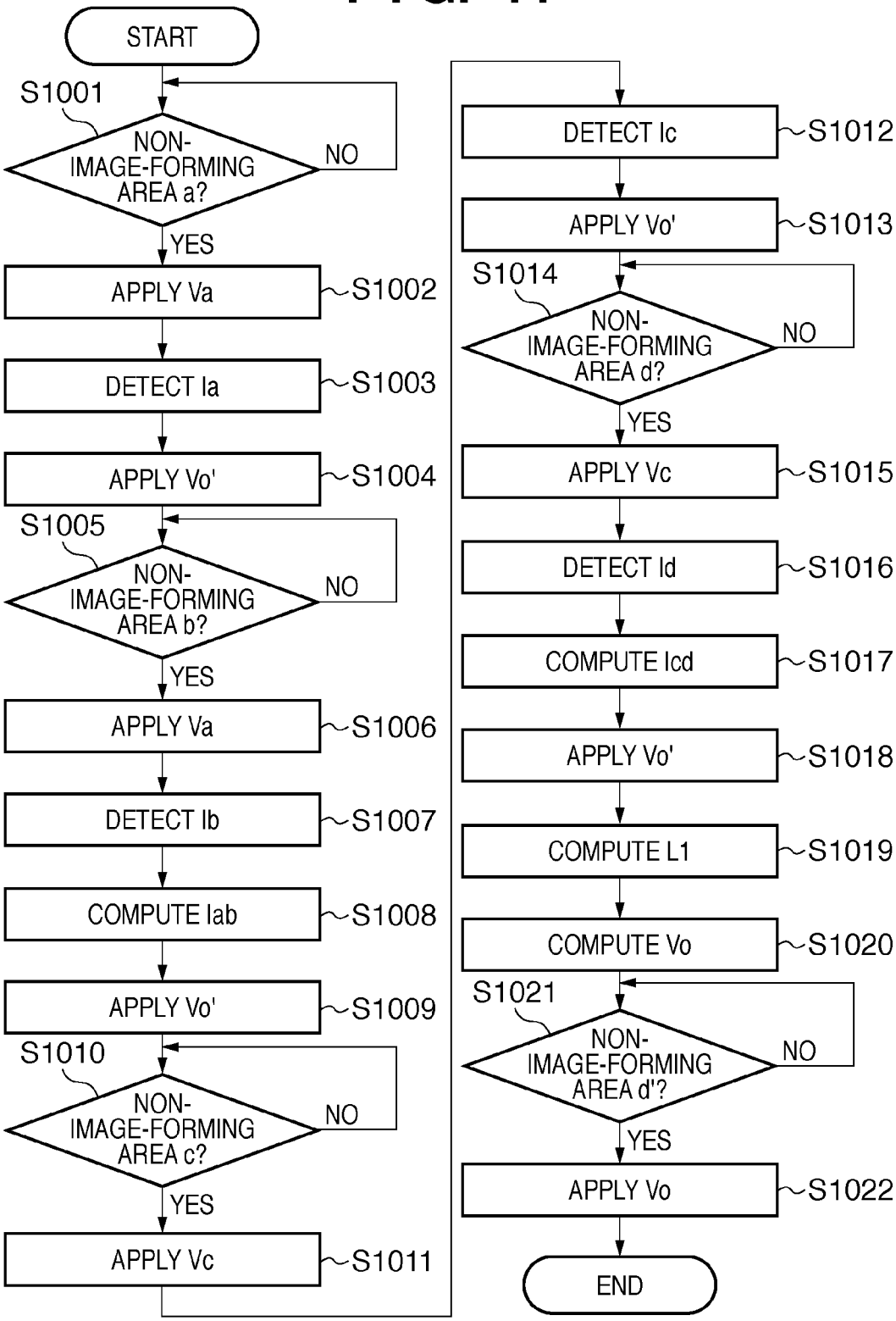
FIG. 11 is a flowchart showing control for determining a primary transfer bias.

FIG. 11 is a flowchart showing control for determining a primary transfer bias when the image forming apparatus 1 continuously forms a plurality of images. The control unit 90 executes the processing of this flowchart.

The control unit 90 checks if a timing at which non-image-forming area a is located on the transfer part is reached (S1001). If the timing at which non-image-forming area a is located on the transfer part is reached, the control unit 90 controls the voltage applying unit 62 to apply a voltage of the voltage value Va to the primary transfer roller 24 (S1002), and acquires (detects) the current value Ia of a current that flows through the primary transfer roller 24 via the current detection unit 64 (S1003). The control unit 90 returns the primary transfer bias to a voltage Vo' determined last (i.e., to apply a voltage of the voltage value Vo') to prepare for the next image-forming area again (S1004).

The control unit 90 checks if a timing at which non-image-forming area b is located on the transfer part is reached (S1005). If the timing at which non-image-forming area b is located on the transfer part is reached, the control unit 90 controls the voltage applying unit 62 to apply a voltage of the voltage value Va to the primary transfer roller 24 (S1006), and acquires (detects) the current value Ib of a current that flows through the primary transfer roller 24 via the current detection unit 64 when the voltage applying unit 62 applies the voltage of the voltage value Va during the period in which non-image-forming area b is located on the transfer part (S1007). The control unit 90 computes the average current value Iab as an average of the current values Ia and Ib (S1008). The control unit 90 returns the primary transfer bias to the voltage Vo' (i.e., to apply a voltage of the voltage value Vo') to prepare for the next image-forming area again (S1009).

The control unit 90 checks if a timing at which non-image-forming area c is located on the transfer part is reached (S1010). If the timing at which non-image-forming area c is located on the transfer part is reached, the control unit 90 controls the voltage applying unit 62 to apply a voltage of the voltage value Vc to the primary transfer roller 24 (S1011), and acquires (detects) the current value Ic of a current that flows through the primary transfer roller 24 via the current detection unit 64 (S1012). The control unit 90 returns the primary transfer bias to the voltage Vo' (i.e., to apply a voltage of the voltage value Vo') to prepare for the next image-forming area again (S1013).

The control unit 90 checks if a timing at which non-image-forming area d is located on the transfer part is reached (S1014). If the timing at which non-image-forming area d is located on the transfer part is reached, the control unit 90 controls the voltage applying unit 62 to apply a voltage of the voltage value Vc to the primary transfer roller 24 (S1015), and acquires (detects) the current value Id of a current that flows through the primary transfer roller 24 via the current detection unit 64 (S1016). The control unit 90 computes the average current value Icd as an average of the current values Ic and Id (S1017). The control unit 90 returns the primary transfer bias to the voltage Vo' (i.e., to apply a voltage of the voltage value Vo') to prepare for the next image-forming area again (S1018).

After that, the control unit 90 computes the impedance characteristic L1 of the primary transfer roller 24, as described above (S1019), and determines (computes) the voltage Vo at which the current Io is obtained (S1020). The control unit 90 checks if a timing at which non-image-forming area d' is located on the transfer part is reached (S1021). If the timing at which non-image-forming area d' is located on the transfer part is reached, the control unit 90 controls the voltage applying unit 62 to apply a voltage of the voltage value Vo to the primary transfer roller 24 after an elapse of a predetermined period of time (S1022). That is, the control unit 90 sets the voltage Vo as the value of a new primary transfer bias.

If the control unit 90 can determine the voltage Vo after the average current value Icd is computed in S1017 and before the next image-forming area is located on the transfer part, it may change the primary transfer bias to the voltage Vo without waiting for non-image-forming area d'.

Since the impedance characteristic of the primary transfer roller 24 never abruptly changes, the impedance of the primary transfer roller 24 can be computed from the current value acquired during a period in which each of a plurality of non-image-forming areas is located on the transfer part. Hence, in this embodiment, in place of applying a plurality of different voltages to the primary transfer roller 24 during a period in which one non-image-forming area is located on the transfer part, different voltages are applied to the primary transfer roller 24 during periods in which the plurality of non-image-forming-areas are respectively located on the transfer part. In other words, the impedance characteristic of the primary transfer roller 24 is computed by combining current values obtained when different voltages are applied to the primary transfer roller 24 during periods in which the plurality of non-image-forming areas are respectively located on the transfer part. In this way, the image forming apparatus 1 requires neither a constant current control circuit nor a transfer bias applying circuit that can quickly change voltage values in the primary transfer bias applying mechanism 60, thus preventing an increase in cost. Since the impedance characteristic of the primary transfer roller 24 is computed from a plurality of current values of currents that flow through the primary transfer roller 24, a voltage to be applied to the primary transfer roller 24 can be controlled with higher precision than the case in which the impedance characteristic is computed from one current value. When a period in which one non-image-forming area is located on the transfer part is equal to or longer than a duration that allows changing a voltage to be applied to the primary transfer roller 24 a plurality of times, the impedance characteristic of the primary transfer roller 24 can be computed during only the period in which one non-image-forming area is located on the transfer part.

Note that the transfer bias control in the primary transfer bias applying mechanism 60 is preferably executed at a predetermined time interval (e.g., every 5 minutes) or for the predetermined number of output print media PM (e.g., 200 sheets). The transfer bias control in the primary transfer bias applying mechanism 60 is preferably executed at a timing different from those of density correction control and other kinds of correction control.

Figure 5:
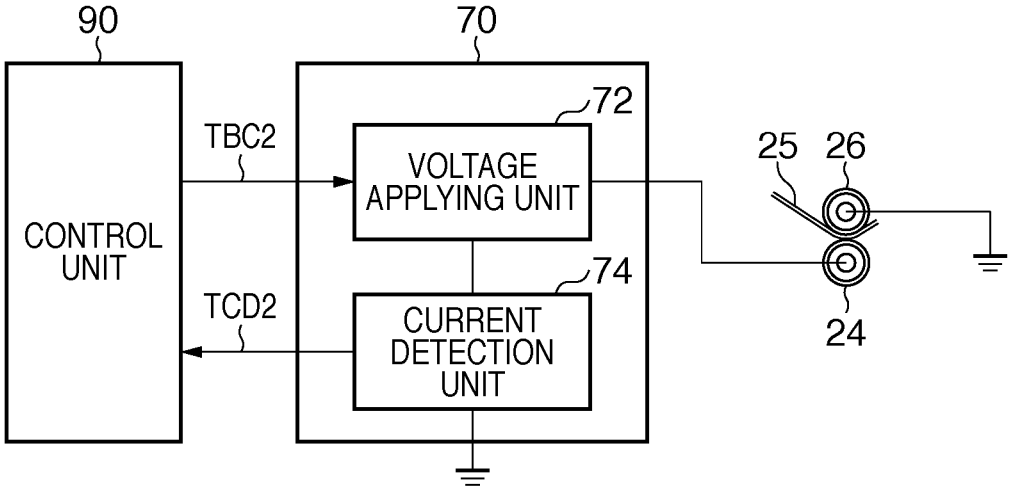
FIG. 5 is a schematic block diagram showing the arrangement of a secondary transfer bias applying mechanism.

The secondary transfer bias applying mechanism 70 for applying a transfer bias to the secondary transfer outer roller 27 will be described below. FIG. 5 is a schematic block diagram showing the arrangement of the secondary transfer bias applying mechanism 70. The secondary transfer bias applying mechanism 70 includes a voltage applying unit 72 and current detection unit 74, as shown in FIG. 5.

The voltage applying unit 72 is controlled by the control unit 90, and has a function of applying a voltage to the secondary transfer outer roller 27 as a member associated with transfer of an image. The voltage applying unit 72 generates a voltage (secondary transfer voltage) to be applied to the secondary transfer outer roller 27 based on a secondary transfer bias control signal TBC2 input from the control unit 90, and applies the generated voltage to the secondary transfer outer roller 27.

The current detection unit 74 detects a current that flows through the secondary transfer outer roller 27 when the voltage applying unit 72 applies the voltage. In this embodiment, the current detection unit 74 detects a current (secondary transfer current) that flows via the secondary transfer outer roller 27, intermediate transfer belt 25, secondary transfer inner roller 26, and the like, and outputs a secondary transfer current detection signal TCD2 indicating the current value of that current to the control unit 90.

The control unit 90 controls the voltage applying unit 72 based on the detection result (i.e., the value of the current flowing through the secondary transfer outer roller 27) of the current detection unit 74 in the secondary transfer bias applying mechanism 70. In other words, the control unit 90 generates the secondary transfer bias control signal TBC2 indicating the voltage value of a voltage to be applied from the voltage applying unit 72 to the secondary transfer outer roller 27 based on the secondary transfer current detection signal TCD2 input from the current detection unit 74, and outputs the generated signal to the voltage applying unit 72.

The transfer bias control of the secondary transfer bias applying mechanism 70 in continuous operations (upon forming a plurality of images) of the image forming apparatus 1 will be described below with reference to FIGS. 6 and 7.

Figure 6:
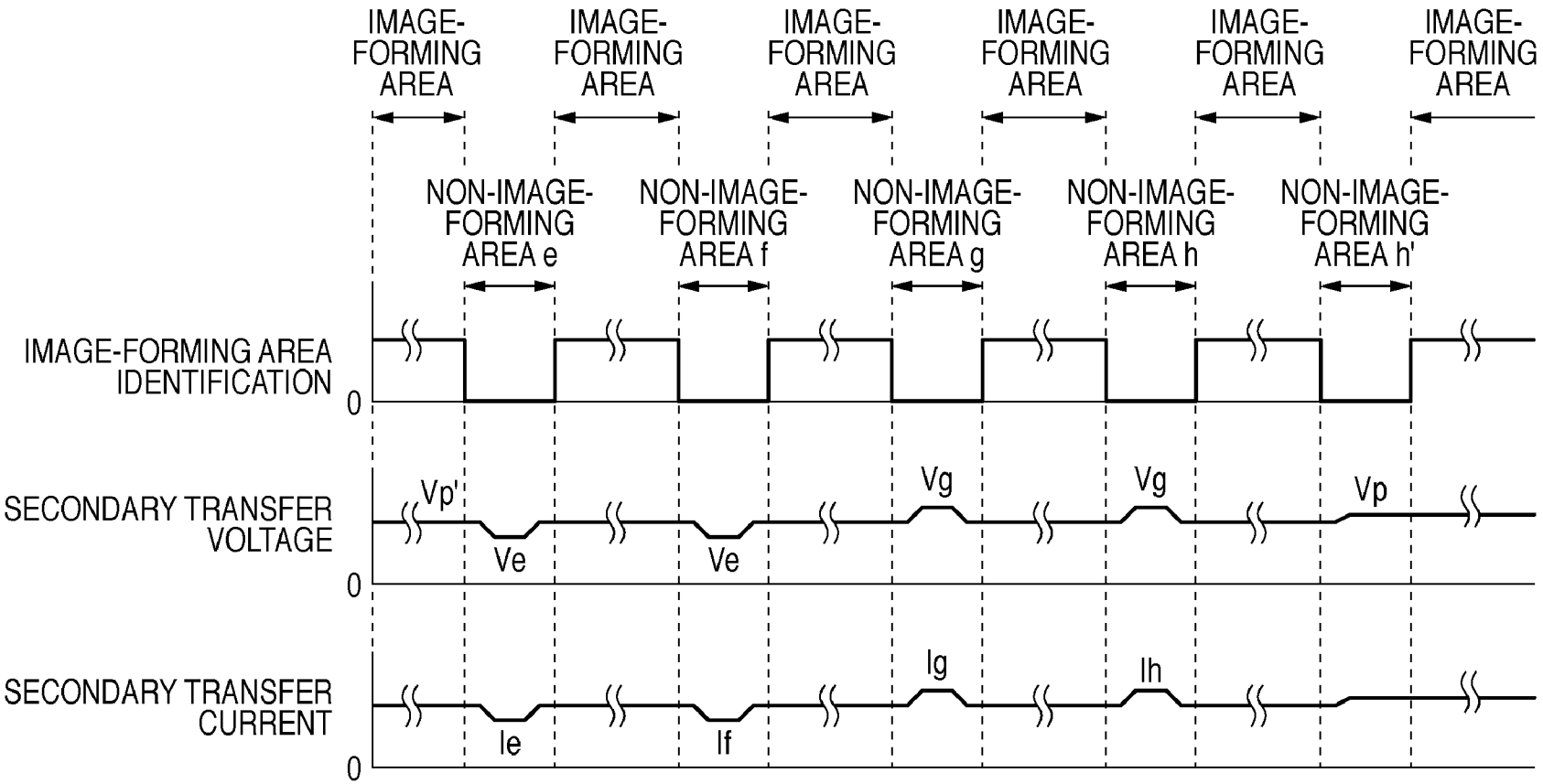
FIG. 6 is a chart showing a secondary transfer voltage and secondary transfer current.

FIG. 6 is a chart showing a secondary transfer voltage and secondary transfer current at timings at each of which an image-forming area is located on a transfer part, and those at each of which a non-image-forming area is located on the transfer part in the continuous operations of the image forming apparatus 1. In FIG. 6, the transfer part is a part where the secondary transfer outer roller 27 and intermediate transfer belt 25 (print medium PM) contact each other. The image-forming area is an area where a toner image can exist from the leading end to the trailing end of an image for one page on the intermediate transfer belt 25. The non-image-forming area includes areas where no toner image exists before the leading end and after the trailing end of an image for one page on the intermediate transfer belt 25.

Referring to FIG. 6, during periods in each of which the image-forming area is located on the transfer part, the control unit 90 controls the voltage applying unit 72 to apply a voltage with a voltage value Vp', which is determined last (normal secondary transfer voltage), to the secondary transfer outer roller 27.

During periods in which non-image-forming areas e and f are respectively located on the transfer part, the control unit 90 controls the voltage applying unit 72 to apply a voltage with a voltage value Ve to the secondary transfer outer roller 27. In this case, during the periods in which non-image-forming areas e and f are respectively located on the transfer part, the control unit 90 acquires, via the current detection unit 74, current values Ie and If of currents that flow through the secondary transfer outer roller 27 upon application of the voltage of the voltage value Ve by the voltage applying unit 72. Also, the control unit 90 computes an average current value Ief as an average of the current values Ie and If.

Furthermore, during periods in which non-image-forming areas g and h are respectively located on the transfer part, the control unit 90 controls the voltage applying unit 72 to apply a voltage with a voltage value Vg to the secondary transfer outer roller 27. In this case, during the periods in which non-image-forming areas g and h are respectively located on the transfer part, the control unit 90 acquires, via the current detection unit 74, current values Ig and Ih of currents that flow through the secondary transfer outer roller 27 upon application of the voltage of the voltage value Vg by the voltage applying unit 72. Also, the control unit 90 computes an average current value Igh as an average of the current values Ig and Ih.

Figure 7:
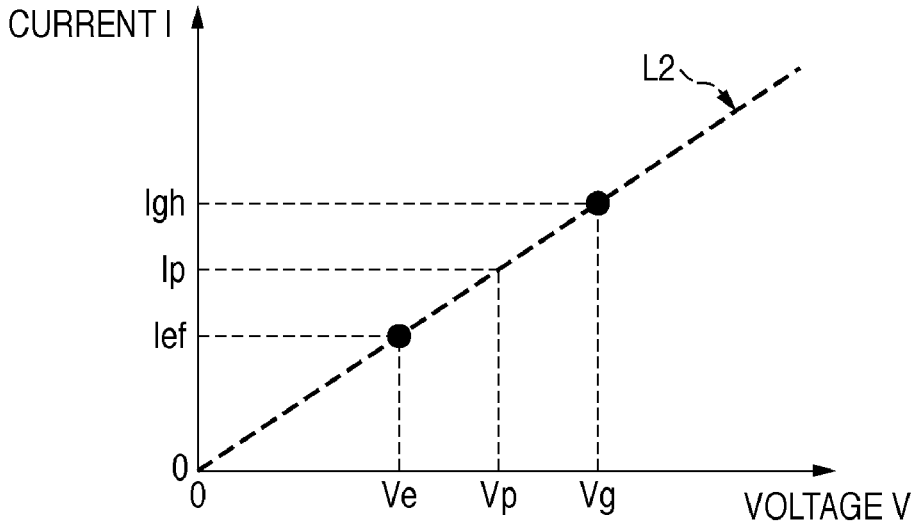
FIG. 7 is a graph showing the relationship between a voltage (voltage value) to be applied to a secondary transfer outer roller and a current (current value) that flows through the secondary transfer outer roller.

FIG. 7 is a graph showing the relationship between a voltage (voltage value) V to be applied to the secondary transfer outer roller 27 and a current (current value) I that flows through the secondary transfer outer roller 27. In FIG. 7, the abscissa plots the voltage V to be applied to the secondary transfer outer roller 27, and the ordinate plots the current I that flows through the secondary transfer outer roller 27. Referring to FIG. 7, the control unit 90 computes an equation of a line L2 from the average current values Ief and Igh that flow through the secondary transfer outer roller 27 when the voltage applying unit 72 applies the voltages of the voltage values Ve and Vg to the secondary transfer outer roller 27, in accordance with equation (2) below. In other words, the control unit 90 computes an impedance characteristic (line L2) of the secondary transfer outer roller 27 based on the voltage values Ve and Vg and the average current values Ief and Igh.

$$V-Ve=\{(Vg-Ve)/(Igh-Ief)\}\cdot(I-Ief) \quad (2)$$

Next, the control unit 90 computes a voltage value Vp at which a current that flows through the secondary transfer outer roller 27 assumes a predetermined current value Ip, based on the line L2 indicating the impedance characteristic of the secondary transfer outer roller 27. Also, the control unit 90 determines the voltage value Vp as a voltage value to be applied from the voltage applying unit 72 to the secondary transfer outer roller 27. The control unit 90 controls the voltage applying unit 72 to apply a voltage of the voltage value Vp to the secondary transfer outer roller 27 during periods in each of which the image-forming area is located on the transfer part.

In this manner, the control unit 90 controls the voltage applying unit 72 to apply a voltage of a first voltage value (Ve) to the secondary transfer outer roller 27 during periods in which first non-image-forming areas (non-image-forming areas e and f) of a plurality of non-image-forming areas are respectively located on the transfer part. Also, the control unit 90 controls the voltage applying unit 72 to apply a voltage of a second voltage value (Vg) to the secondary transfer outer roller 27 during periods in which second non-image-forming areas (non-image-forming areas g and h) of the plurality of non-image-forming areas are respectively located on the transfer part. In this case, the control unit 90 acquires first current values (Ie and If) of currents that flow through the secondary transfer outer roller 27 upon applying the voltage of the first voltage value, and second current values (Ig and Ih) of currents that flow through the secondary transfer outer roller 27 upon applying the voltage of the second voltage value. Then, the control unit 90 computes the impedance characteristic of the secondary transfer outer roller 27 based on an average current value (Ief) of the first current values, and an average current value (Igh) of the second current values. After that, the control unit 90 determines a voltage value (Vp) of a voltage to be applied to the secondary transfer outer roller 27 based on the impedance characteristic, so that the current value of a current, that flows through the secondary transfer outer roller 27 in a period in which the next image-forming area is located on the transfer part, assumes a predetermined value (Ip). Note that during a preparation operation (pre-rotation) required to start an image forming operation, the control unit 90 detects the current values Ie and If of currents that flow through the secondary transfer outer roller 27 while changing a voltage to be applied to the secondary transfer outer roller 27 to Ve and Vg, thereby determining the voltage Vp'.

Figure 12:
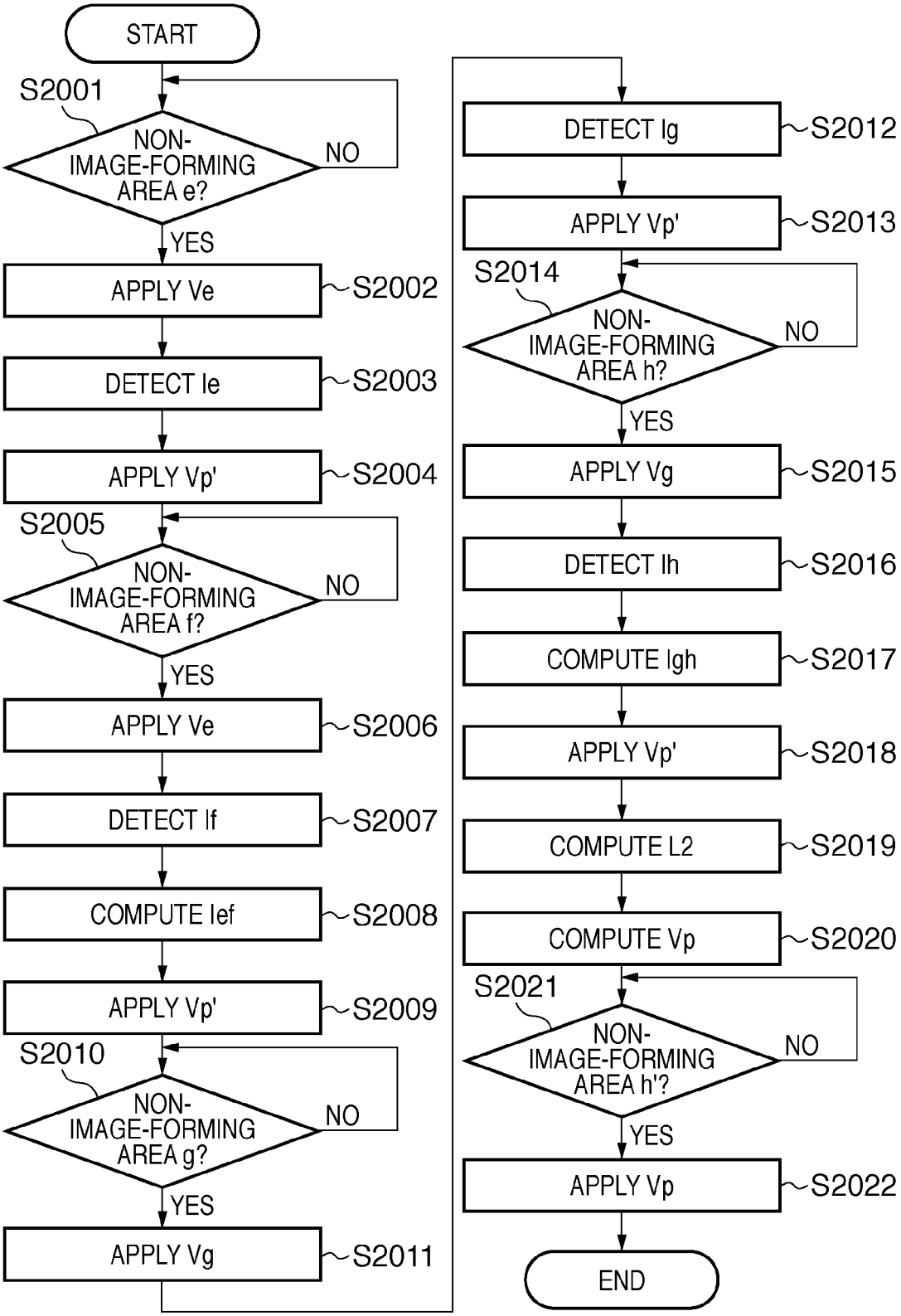
FIG. 12 is a flowchart showing control for determining a secondary transfer bias.

FIG. 12 is a flowchart showing control for determining a secondary transfer bias when the image forming apparatus 1 continuously forms a plurality of images. The control unit 90 executes the processing of this flowchart.

The control unit 90 checks if a timing at which non-image-forming area e is located on the transfer part is reached (S2001). If the timing at which non-image-forming area e is located on the transfer part is reached, the control unit 90 controls the voltage applying unit 72 to apply a voltage of the voltage value Ve to the secondary transfer outer roller 27 (S2002), and acquires (detects) the current value Ie of a current that flows through the secondary transfer outer roller 27 via the current detection unit 74 (S2003). The control unit 90 returns the secondary transfer bias to Vp' (i.e., to apply a voltage of the voltage value Vp') to prepare for the next image-forming area again (S2004).

The control unit 90 checks if a timing at which non-image-forming area f is located on the transfer part is reached (S2005). If the timing at which non-image-forming area f is located on the transfer part is reached, the control unit 90 controls the voltage applying unit 72 to apply a voltage of the voltage value Ve to the secondary transfer outer roller 27 (S2006), and acquires (detects) the current value If of a current that flows through the secondary transfer outer roller 27 via the current detection unit 74 (S2007). The control unit 90 computes the average current value Ief as an average of the current values Ie and If (S2008). The control unit 90 controls the voltage applying unit 72 to apply a voltage of the voltage value Vp' to the secondary transfer outer roller 27 to prepare for the next image-forming area again (S2009). That is, the control unit 90 returns the secondary transfer bias to the voltage Vp'.

The control unit 90 checks if a timing at which non-image-forming area g is located on the transfer part is reached (S2010). If the timing at which non-image-forming area g is located on the transfer part is reached, the control unit 90 controls the voltage applying unit 72 to apply a voltage of the voltage value Vg to the secondary transfer outer roller 27 (S2011), and acquires (detects) the current value Ig of a current that flows through the secondary transfer outer roller 27 via the current detection unit 74 (S2012). The control unit 90 returns the secondary transfer bias to Vp' (i.e., to apply a voltage of the voltage value Vp') to prepare for the next image-forming area again (S2013).

The control unit 90 checks if a timing at which non-image-forming area h is located on the transfer part is reached (S2014). If the timing at which non-image-forming area h is located on the transfer part is reached, the control unit 90 controls the voltage applying unit 72 to apply a voltage of the voltage value Vg to the secondary transfer outer roller 27 (S2015), and acquires (detects) the current value Ih of a current that flows through the secondary transfer outer roller 27 via the current detection unit 74 (S2016). The control unit 90 computes the average current value Igh as an average of the current values Ig and Ih (S2017). The control unit 90 returns the secondary transfer bias to Vp' (i.e., to apply a voltage of the voltage value Vp') to prepare for the next image-forming area again (S2018).

After that, the control unit 90 computes the impedance characteristic L2 of the secondary transfer outer roller 27, as described above (S2019), and determines (computes) the voltage Vp at which the current Ip is obtained (S2020). The control unit 90 checks if a timing at which non-image-forming area h' is located on the transfer part is reached (S2021). If the timing at which non-image-forming area h' is located on the transfer part is reached, the control unit 90 controls the voltage applying unit 72 to apply a voltage of the voltage value Vp to the secondary transfer outer roller 27 after an elapse of a predetermined period of time (S2022). That is, the control unit 90 sets the voltage Vp as the value of a new secondary transfer bias.

If the control unit 90 can determine the voltage Vp after the average current value Igh is computed in S2017 and before the next image-forming area is located on the transfer part, it may change the secondary transfer bias to the voltage Vp without waiting for non-image-forming area h'.

Since the impedance characteristic of the secondary transfer outer roller 27 never abruptly changes, the impedance of the secondary transfer outer roller 27 can be computed from the current value acquired during a period in which each of a plurality of non-image-forming areas is located on the transfer part. Hence, in this embodiment, in place of applying a plurality of different voltages to the secondary transfer outer roller 27 during a period in which one non-image-forming area is located on the transfer part, different voltages are applied to the secondary transfer outer roller 27 during periods in which the plurality of non-image-forming-areas are respectively located on the transfer part. In other words, the impedance characteristic of the secondary transfer outer roller 27 is computed by combining current values obtained when different voltages are applied to the secondary transfer outer roller 27 during periods in which the plurality of non-image-forming areas are respectively located on the transfer part. In this way, the image forming apparatus 1 requires neither a constant current control circuit nor a transfer bias applying circuit that can quickly change voltage values in the secondary transfer bias applying mechanism 70, thus preventing an increase in cost. Since the impedance characteristic of the secondary transfer outer roller 27 is computed from a plurality of current values of currents that flow through the secondary transfer outer roller 27, a voltage to be applied to the secondary transfer outer roller 27 can be controlled with higher precision than the case in which the impedance characteristic is computed from one current value. When a period in which one non-image-forming area is located on the transfer part is equal to or longer than a duration that allows changing a voltage to be applied to the secondary transfer outer roller 27 a plurality of times, the impedance characteristic of the secondary transfer outer roller 27 can be computed during only the period in which one non-image-forming area is located on the transfer part.

Figure 8:
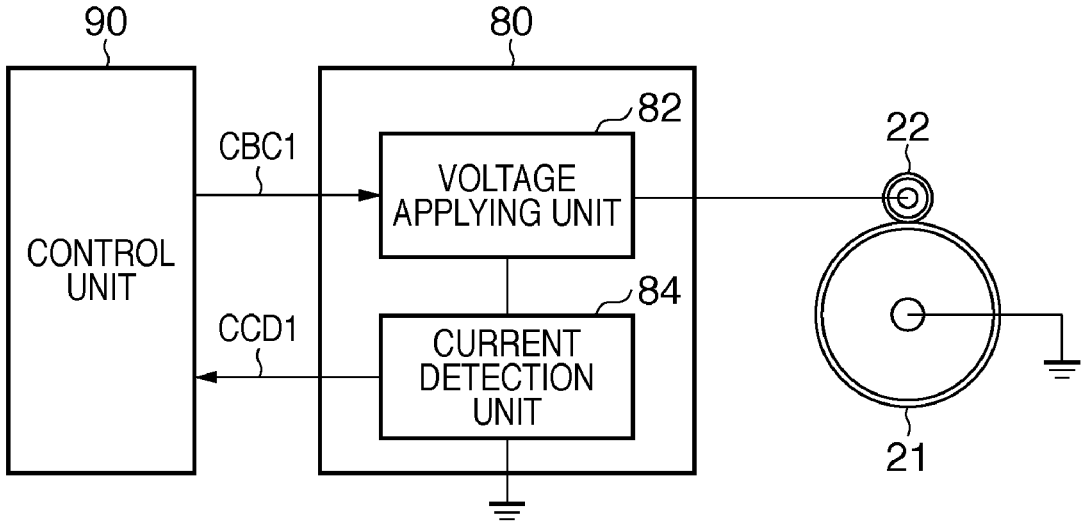
FIG. 8 is a schematic block diagram showing the arrangement of a primary charging bias applying mechanism.

The primary charging bias applying mechanism 80 for applying a charging bias to the primary charging roller 22 will be described below. FIG. 8 is a schematic block diagram showing the arrangement of the primary charging bias applying mechanism 80. The primary charging bias applying mechanism 80 includes a voltage applying unit 82 and current detection unit 84, as shown in FIG. 8.

The voltage applying unit 82 is controlled by the control unit 90, and has a function of applying a voltage (a voltage obtained by superposing an AC voltage on a DC voltage) to the primary charging roller 22 as a member associated with formation of an image. The voltage applying unit 82 generates a voltage (primary charging voltage) to be applied to the primary charging roller 22 based on a primary charging bias control signal CBC1 input from the control unit 90, and applies the generated voltage to the primary charging roller 22.

The current detection unit 84 detects a current that flows through the primary charging roller 22 when the voltage applying unit 82 applies the voltage. In this embodiment, the current detection unit 84 detects a current (primary charging current) that flows via the primary charging roller 22, photosensitive drum 21, and the like, and outputs a primary charging current detection signal CCD1 indicating the current value of that current to the control unit 90.

The control unit 90 controls the voltage applying unit 82 based on the detection result (i.e., the value of the current flowing through the primary charging roller 22) of the current detection unit 84 in the primary charging bias applying mechanism 80. In other words, the control unit 90 generates the primary charging bias control signal CBC1 indicating a voltage value of the voltage to be applied by the voltage applying unit 82 to the primary charging roller 22 based on the primary charging current detection signal CCD1 input from the current detection unit 84, and outputs the generated signal to the voltage applying unit 82.

The control of the primary charging bias applying mechanism 80 in the continuous operations (upon forming a plurality of images) of the image forming apparatus 1 will be described below with reference to FIGS. 9 and 10.

Figure 9:
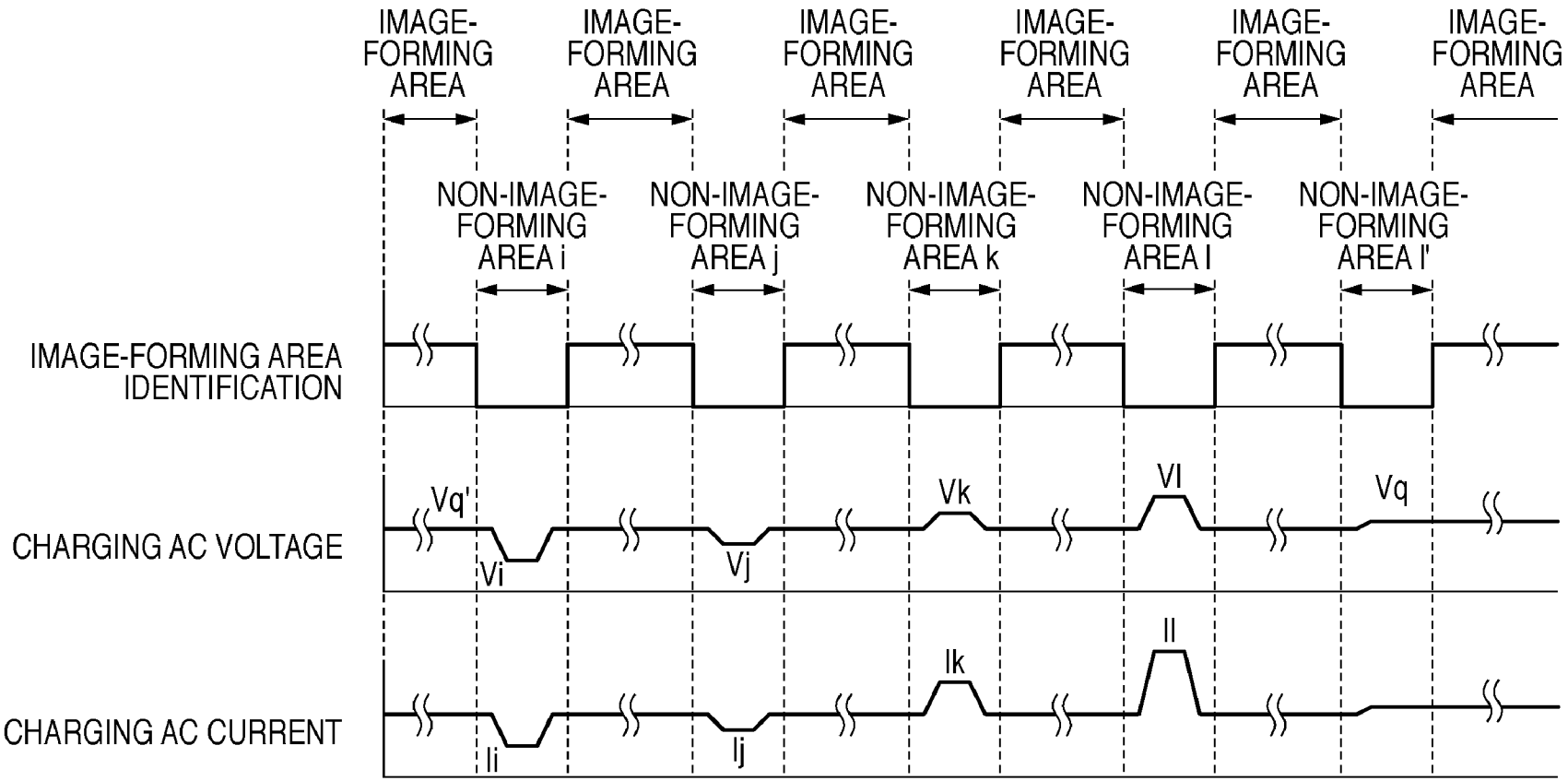
FIG. 9 is a chart showing a primary charging voltage and primary charging current.

FIG. 9 is a chart showing a primary charging voltage and primary charging current during periods in each of which an image-forming area is located on a charging part, and those in each of which a non-image-forming area is located on the charging part in the continuous operations of the image forming apparatus 1. In FIG. 9, the charging part is a part where the primary charging roller 22 and photosensitive drum 21 contact each other. The image-forming area is an area where a toner image is planned to be formed from the leading end to the trailing end of an image for one page on the photosensitive drum 21. The non-image-forming area includes areas where no toner image is planned to be formed before the leading end and after the trailing end of an image for one page on the photosensitive drum 21.

Referring to FIG. 9, during periods in each of which the image-forming area is located on the charging part, the control unit 90 controls the voltage applying unit 82 to apply a voltage with a voltage value Vq', which is determined last (normal primary charging voltage), to the primary charging roller 22.

During a period in which non-image-forming area i is located on the charging part, the control unit 90 controls the voltage applying unit 82 to apply a voltage value Vi of a non-discharging area. Note that the voltage of the non-discharging area falls within a voltage range in which the primary charging roller 22 does not cause discharging even when the voltage is applied to the primary charging roller 22. In this case, during the period in which non-image-forming area i is located on the charging part, the control unit 90 acquires, via the current detection unit 84, a value Ii of a current that flows through the primary charging roller 22 upon application of the voltage of the voltage value Vi by the voltage applying unit 82.

During a period in which non-image-forming area j is located on the charging part, the control unit 90 controls the voltage applying unit 82 to apply a voltage value Vj of the non-discharging area. In this case, during the period in which non-image-forming area j is located on the charging part, the control unit 90 acquires, via the current detection unit 84, a current value Ij of a current that flows through the primary charging roller 22 upon application of the voltage of the voltage value Vj by the voltage applying unit 82.

During a period in which non-image-forming area k is located on the charging part, the control unit 90 controls the voltage applying unit 82 to apply a voltage value Vk of a discharging area. Note that the voltage of the discharging area falls within a voltage range in which the primary charging roller 22 causes discharging when the voltage is applied to the primary charging roller. In this case, during the period in which non-image-forming area k is located on the charging part, the control unit 90 acquires, via the current detection unit 84, a current value Ik of a current that flows through the primary charging roller 22 upon application of the voltage of the voltage value Vk by the voltage applying unit 82.

During a period in which non-image-forming area l is located on the charging part, the control unit 90 controls the voltage applying unit 82 to apply a voltage value Vl of the discharging area. In this case, during the period in which non-image-forming area 1 is located on the charging part, the control unit 90 acquires, via the current detection unit 84, a current value Il of a current that flows through the primary charging roller 22 upon application of the voltage of the voltage value Vl by the voltage applying unit 82.

Figure 10:
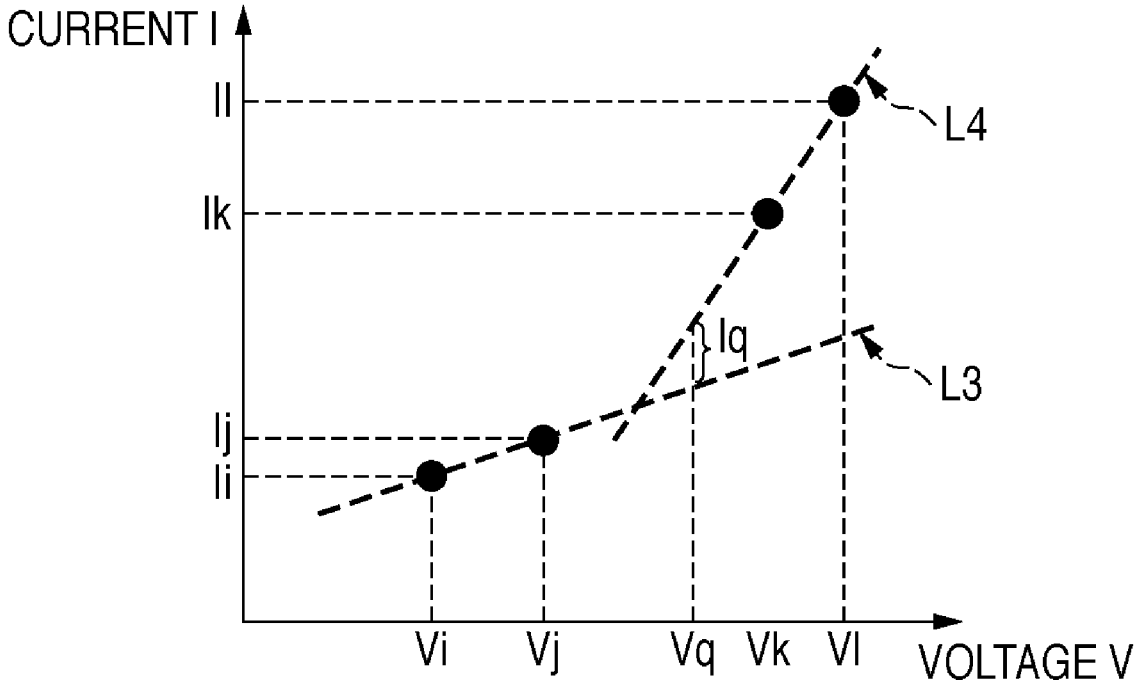
FIG. 10 is a graph showing the relationship between a voltage (voltage value) to be applied to a primary charging roller and a current (current value) that flows through the primary charging roller.

FIG. 10 is a graph showing the relationship between a voltage (voltage value) V to be applied to the primary charging roller 22 and a current (current value) I that flows through the primary charging roller 22. In FIG. 10, the abscissa plots the voltage V to be applied to the primary charging roller 22, and the ordinate plots the current I that flows through the primary charging roller 22.

Referring to FIG. 10, the control unit 90 computes an equation of a line L3 from the current values Ii and Ij of currents that flow through the primary charging roller 22 when the voltage applying unit 82 applies the voltages of the voltage values Vi and Vj of the non-discharging area to the primary charging roller 22, in accordance with equation (3) below. In other words, the control unit 90 computes a first impedance characteristic (line L3) of the primary charging roller 22 based on the voltage values Vi and Vj, and the current values Ii and Ij.

$$I-Ii=\{(Ij-Ii)/(Vj-Vi)\}\cdot(V-Vi) \quad (3)$$

Likewise, the control unit 90 computes an equation of a line L4 from the current values Ik and Il of currents that flow through the primary charging roller 22 when the voltage applying unit 82 applies the voltages of the voltage values Vk and Vl of the discharging area to the primary charging roller 22, in accordance with equation (4) below. In other words, the control unit 90 computes a second impedance characteristic (line L4) of the primary charging roller 22 based on the voltage values Vk and Vl, and the current values Ik and Il.

$$I-Ik=\{(Il-Ik)/(Vl-Vk)\}\cdot(V-Vk) \quad (4)$$

Note that a voltage range lower than the intersection between the lines L3 and L4 corresponds to the non-discharging area, and a voltage range higher than the intersection corresponds to the discharging area.

Next, the control unit 90 computes a voltage value Vq at which a difference between a current that flows through the primary charging roller 22 based on the line L3 and a current that flows through the primary charging roller 22 based on the line L4 assumes a predetermined current value Iq. Also, the control unit 90 determines the voltage value Vq as a voltage value to be applied from the voltage control unit 82 to the primary charging roller 22. Then, the control unit 90 controls the voltage applying unit 82 to apply a voltage of the voltage value Vq to the primary charging roller 22 at a timing at which an image-forming area is located on the charging part. Note that during a preparation operation (pre-rotation) required to start an image forming operation, the control unit 90 detects the currents Ii, Ij, Ik, and Il that flow through the primary charging roller 22 while changing a voltage to be applied to the primary charging roller 22 to Vi, Vj, Vk, and Vl, thereby determining the voltage Vq'.

Figure 13:
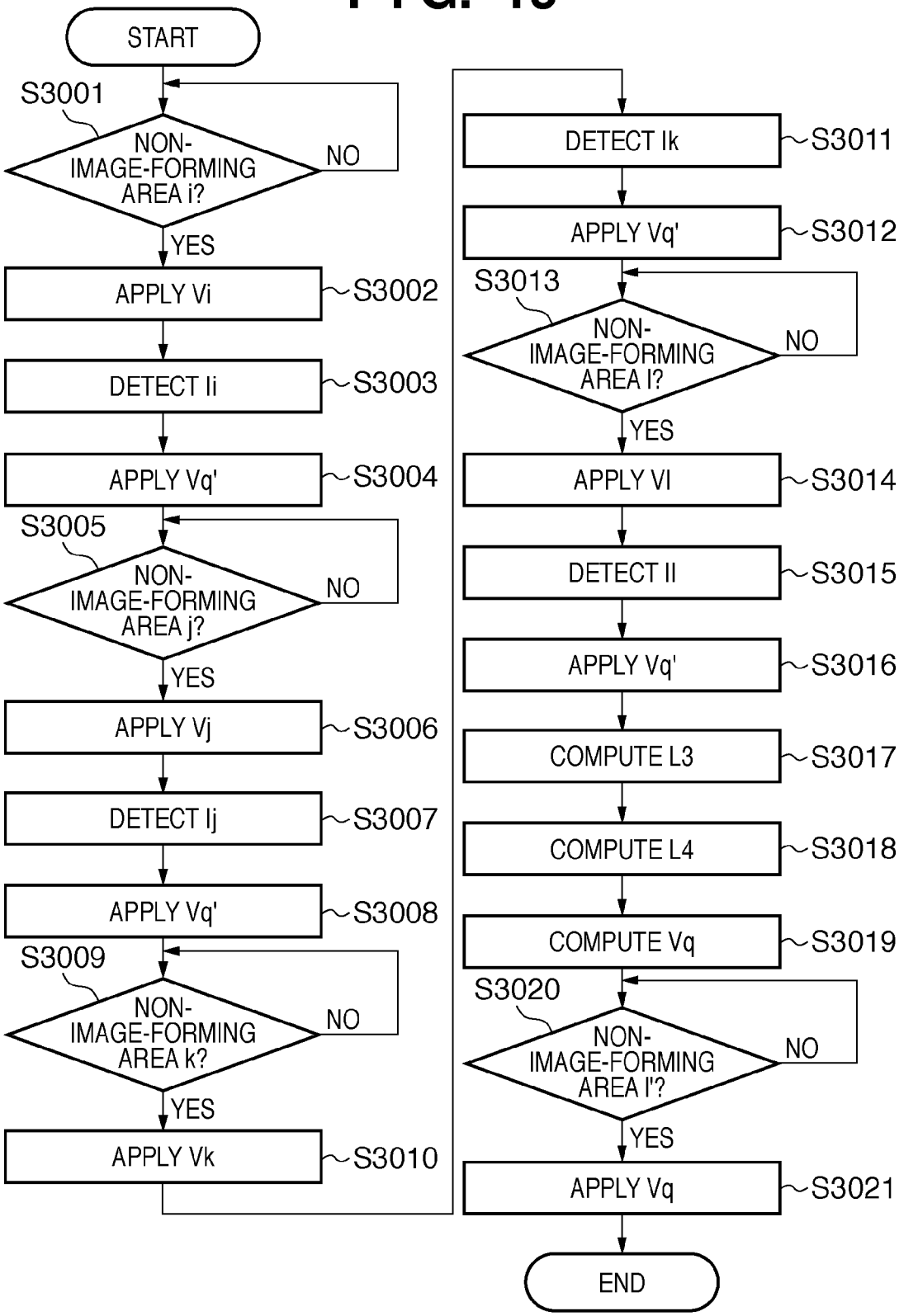
FIG. 13 is a flowchart showing control for determining a primary charging bias.

FIG. 13 is a flowchart showing control for determining a primary charging bias when the image forming apparatus 1 continuously forms a plurality of images. The control unit 90 executes the processing of this flowchart.

The control unit 90 checks if a timing at which non-image-forming area i is located on the charging part is reached (S3001). If the timing at which non-image-forming area i is located on the charging part is reached, the control unit 90 controls the voltage applying unit 82 to apply a voltage of the voltage value Vi of the non-discharging area (S3002), and acquires (detects) the current value Ii of a current that flows through the primary charging roller 22 via the current detection unit 84 (S3003). The control unit 90 controls the voltage applying unit 82 to apply the voltage value Vq' to prepare for the next image-forming area again (S3004). That is, the control unit 90 returns the primary charging bias to the voltage Vq'.

The control unit 90 checks if a timing at which non-image-forming area j is located on the charging part is reached (S3005). If the timing at which non-image-forming area j is located on the charging part is reached, the control unit 90 controls the voltage applying unit 82 to apply a voltage of the voltage value Vj of the non-discharging area (S3006), and acquires (detects) the current value Ij of a current that flows through the primary charging roller 22 via the current detection unit 84 (S3007). The control unit 90 returns the primary charging bias to the voltage Vq' (i.e., to apply a voltage of the voltage value Vq') to prepare for the next image-forming area again (S3008).

The control unit 90 checks if a timing at which non-image-forming area k is located on the charging part is reached (S3009). If the timing at which non-image-forming area k is located on the charging part is reached, the control unit 90 controls the voltage applying unit 82 to apply a voltage of the voltage value Vk of the discharging area (S3010), and acquires (detects) the current value Ik of a current that flows through the primary charging roller 22 via the current detection unit 84 (S3011). The control unit 90 returns the primary charging bias to the voltage Vq' (i.e., to apply a voltage of the voltage value Vq') to prepare for the next image-forming area again (S3012).

The control unit 90 checks if a timing at which non-image-forming area l is located on the charging part is reached (S3013). If the timing at which non-image-forming area l is located on the charging part is reached, the control unit 90 controls the voltage applying unit 82 to apply a voltage of the voltage value Vl of the discharging area (S3014), and acquires (detects) the current value Il of a current that flows through the primary charging roller 22 via the current detection unit 84 (S3015). The control unit 90 returns the primary charging bias to the voltage Vq' (i.e., to apply a voltage of the voltage value Vq') to prepare for the next image-forming area again (S3016).

The control unit 90 computes the impedance characteristics L3 and L4 of the primary charging roller 22 (S3017, S3018), as described above, and determines (computes) the voltage Vq at which a current value computed based on the difference between the lines L3 and L4 assumes Iq (S3019). The control unit 90 checks if a timing at which non-image-forming area l' is located on the charging part is reached (S3020). If the timing at which non-image-forming area l' is located on the charging part is reached, the control unit 90 controls the voltage applying unit 82 to apply a voltage of the determined voltage value Vq to the primary charging roller 22 (S3021).

In this way, the control unit 90 controls the voltage applying unit 82 to apply a voltage of a first voltage value (Vi) of the non-discharging area to the primary charging roller 22 during a period in which a first non-image-forming area (non-image-forming area i) of a plurality of non-image-forming areas is located on the charging part. In this case, the control unit 90 acquires a first current value (Ii) of a current that flows through the primary charging roller 22 upon application of the voltage of the first voltage value. The control unit 90 controls the voltage applying unit 82 to apply a voltage of a second voltage value (Vj) of the non-discharging area to the primary charging roller 22 during a period in which a second non-image-forming area (non-image-forming area j) of the plurality of non-image-forming areas is located on the charging part. In this case, the control unit 90 acquires a second current value (Ij) of a current that flows through the primary charging roller 22 upon application of the voltage of the second voltage value. The control unit 90 controls the voltage applying unit 82 to apply a voltage of a third voltage value (Vk) of the discharging area to the primary charging roller 22 during a period in which a third non-image-forming area (non-image-forming area k) of the plurality of non-image-forming areas is located on the charging part. In this case, the control unit 90 acquires a third current value (Ik) of a current that flows through the primary charging roller 22 upon application of the voltage of the third voltage value. The control unit 90 controls the voltage applying unit 82 to apply a voltage of a fourth voltage value (Vl) of the discharging area to the primary charging roller 22 during a period in which a fourth non-image-forming area (non-image-forming area l) of the plurality of non-image-forming areas is located on the charging part. In this case, the control unit 90 acquires a fourth current value (Il) of a current that flows through the primary charging roller 22 upon application of the voltage of the fourth voltage value. The control unit 90 then computes the first impedance characteristic of the primary charging roller 22 based on the first and second current values, and also the second impedance characteristic of the primary charging roller 22 based on the third and fourth current values. Furthermore, the control unit 90 determines a voltage value (Vq) of a voltage to be applied to the primary charging roller 22, at which the difference between a current that flows through the primary charging roller 22 based on the first impedance characteristic and a current that flows through the primary charging roller 22 based on the second impedance characteristic assumes a predetermined value (Iq).

Since the impedance characteristics of the primary charging roller 22 never abruptly change, the impedances of the primary charging roller 22 can be computed based on current values acquired at timings at which a plurality of non-image-forming areas are respectively located on the charging part. Hence, in this embodiment, different voltages of the non-discharging and discharging areas are applied to the primary charging roller 22 during periods in which the plurality of non-image-forming areas are respectively located on the charging part. In other words, the impedance characteristics of the primary charging roller 22 are computed by combining the current values obtained when the different voltages of the non-discharging and discharging areas are applied to the primary charging roller 22 during periods in which the plurality of non-image-forming areas are respectively located on the charging part. In this way, the image forming apparatus 1 requires neither a constant current control circuit nor a charging bias apply circuit that can quickly change voltage values in the primary charging bias applying mechanism 80, thus preventing an increase in cost. Since the impedance characteristics of the primary charging roller 22 are computed based on a plurality of current values of currents that flow through the primary charging roller 22, a voltage to be applied to the primary charging roller 22 can be controlled with higher precision than the case in which the impedance characteristics are computed based only on one current value. When a period in which one non-image-forming area is located on the charging part is equal to or longer than a duration that allows changing a voltage to be applied to the primary charging roller 22 a plurality of times, the impedance characteristics of the primary charging roller 22 can be computed during only the period in which one non-image-forming area is located on the charging part.

As described above, according to the image forming apparatus 1, biases (voltages) to be applied to the transfer rollers and charging roller can be controlled with high precision without increasing cost. In this embodiment, the image forming apparatus 1 independently includes the primary transfer bias applying mechanism 60, secondary transfer bias applying mechanism 70, and primary charging bias applying mechanism 80. However, the image forming apparatus 1 may includes one bias applying mechanism that combines the functions of the primary transfer bias applying mechanism 60, secondary transfer bias applying mechanism 70, and primary charging bias applying mechanism 80.

The present invention can also be applied to a monochrome image forming apparatus or color image forming apparatus, which does not have any intermediate transfer belt. In this case, a toner image formed on a photosensitive drum is directly transferred onto a print medium PM.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-205847 filed on Aug. 7, 2007, which is hereby incorporated by reference herein in its entirety.

What is claimed is:

1. An image forming apparatus comprising:

a photosensitive member;

a charger configured to charge said photosensitive member;

a voltage applying unit configured to apply a voltage to said charger;

a current detection unit configured to detect a current that flows through said charger upon application of the voltage by said voltage applying unit; and a control unit configured to control said voltage applying unit based on a detection result of said current detection unit, wherein when a plurality of images are to be formed continuously, said control unit controls said voltage applying unit to apply a voltage of a first value that does not cause discharging by said charger during a first period in which a first non-image-forming area is located on a charging part where said photosensitive member is charged by said charger, to apply a voltage of a second value that does not cause discharging during a second period in which a second non-image-forming area is located on the charging part, to apply a voltage of a third value that causes discharging during a third period in which a third non-image-forming area is located on the charging part, and to apply a voltage of a fourth value that causes discharging during a fourth period in which a fourth non-image-forming area is located on the charging part, and image-forming areas exist between the neighboring first to fourth non-image-forming areas, and wherein said control unit determines a voltage value to be applied from said voltage applying unit to said charger during a period in which the image-forming area where an image is formed is located on the charging part, based on the voltages of the first to fourth values, and the detection results of said current detection unit during the first to fourth periods.

2. The apparatus according to claim 1, wherein said control unit determines a first impedance characteristic of said charger upon application of the voltage that does not cause discharging, based on the voltage of the first value, the voltage of the second value, and detection results of said current detection units during the first period and the second period, and determines a second impedance characteristic of said charger upon application of the voltage that causes discharging, based on the voltage of the third value, the voltage of the fourth value, and detection results of said current detection units during the third period and the fourth period, and wherein said control unit determines a voltage value, at which a current value computed based on a difference between the first impedance characteristic and the second impedance characteristic assumes a predetermined value, as a voltage value to be applied by said voltage applying unit during a period in which the image-forming area where an image is formed is located on the charging area.

3. The apparatus according to claim 1, wherein said charger is a charging roller which is in contact with said photosensitive body.

4. A method of controlling an image forming apparatus, which comprises a photosensitive member, a charger which charges the photosensitive member, a voltage applying unit which applies a voltage to the charger, and a current detection unit which detect a current that flows through the charger upon application of the voltage by the voltage applying unit, said method comprising:

a first voltage applying step of controlling the voltage applying unit to apply a voltage of a first value that does not cause discharging by the charger during a first period in which a first non-image-forming area is located on a charging part where the photosensitive member is charged by the charger;

a second voltage applying step of controlling the voltage applying unit to apply a voltage of a second value that does not cause discharging during a second period in which a second non-image-forming area is located on the charging part;

a third voltage applying step of controlling the voltage applying unit to apply a voltage of a third value that causes discharging during a third period in which a third non-image-forming area is located on the charging part;

a fourth voltage applying step of controlling the voltage applying unit to apply a voltage of a fourth value that causes discharging during a fourth period in which a fourth non-image-forming area is located on the charging part; and a determination step of determining a voltage value to be applied from the voltage applying unit to the charger during a period in which an image-forming area where an image is formed is located on the charging part, based on the voltages of the first to fourth values, and the detection results of the current detection unit during the first to fourth periods, wherein a first image-forming area exists between the first non-image-forming area and the second non-image-forming area, a second image-forming area exists between the second non-image-forming area and the third non-image-forming area, and a third image-forming area exists between the third non-image-forming area and the fourth non-image-forming area.

* * * * *